US006820402B1

(12) United States Patent
Haberstroh et al.

(10) Patent No.: US 6,820,402 B1
(45) Date of Patent: Nov. 23, 2004

(54) STRAPPING MACHINE WITH PIVOTING DISPENSER LOADING

(75) Inventors: James A. Haberstroh, Vernon Hills, IL (US); Timothy B. Pearson, Antioch, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 10/600,233

(22) Filed: Jun. 20, 2003

(51) Int. Cl.[7] ..... B65B 13/04
(52) U.S. Cl. ..... 53/589; 100/26
(58) Field of Search ..... 53/168, 589; 100/8, 100/25, 26, 33 PB, 912; 242/558, 597.4

(56) References Cited

U.S. PATENT DOCUMENTS 4,400,928 A * 8/1983 Watanabe ..... 53/168
D308,977 S * 7/1990 Sakaki ..... D15/145
5,079,899 A * 1/1992 Kurachi ..... 53/589
5,299,407 A * 4/1994 Schuttler et al. ..... 53/168
5,615,538 A * 4/1997 Miyashita et al. ..... 53/589
6,141,946 A * 11/2000 Chin-Chang et al. ..... 53/589
6,233,910 B1 * 5/2001 Hataya ..... 53/589
6,655,117 B2 * 12/2003 Hoshino ..... 53/589
D488,822 S * 4/2004 Shibazaki et al. ..... D15/145

* cited by examiner

*Primary Examiner*—Stephen F. Gerrity
(74) *Attorney, Agent, or Firm*—Mark W. Croll, Esq.; Donald J. Breh, Esq.; Welsh & Katz, Ltd.

(57) ABSTRACT

A dispenser assembly for a strapping machine of the type having a frame supporting a feed assembly, a chute and a strap supply provides ready accessibility and ease of loading or reloading a coil of strap material in the machine. A strapping machine includes a strapping head disposed between the feed assembly and the chute. The machine is configured to receive first and second courses of associated strap material, position, tension and seal the strap material around a load. The strap material is provided on a coil having a axis of rotation about which the coil rotates to dispense the strap material. The dispenser assembly includes a support panel hingedly mounted to the frame that is pivotable between an open position and a closed position. The support panel includes a central hub defining an axis for carrying the coil of strap material. The hub is mounted to the support panel such that the axis is in a substantially horizontal orientation when the panel is closed and in a substantially upstanding orientation when the panel is open. A latching, element secures the support panel in the closed position. A strapping machine having a dispenser assembly is also disclosed.

18 Claims, 2 Drawing Sheets

STRAPPING MACHINE WITH PIVOTING DISPENSER LOADING

BACKGROUND OF THE INVENTION

The present invention is directed to a strapping machine having an improved dispenser location and loading arrangement. More particularly, the present invention is directed to a strapping machine having a dispenser that is loaded internally and is mounted to a pivotable door.

Strapping machines are in widespread use for securing straps around loads. One type of known strapper is a stationary unit that includes a strapping head or weld head and drive mechanism mounted within a frame. A chute is mounted to the frame, through which the strapping material is fed. In a typical arrangement, a table-top or work surface is likewise mounted to the frame.

In a typical stationary strapper, the chute is mounted from about the work surface, and the strapping head is mounted below the work surface. Strap is fed from a source or dispenser to the strapping or welding head. The strapping head guides the strap, grips that strap, seals the strap and cuts the strap from the strap supply (i.e., the dispenser end).

Strapping material is fed from the dispenser into the strapping head first via a pair of infeed wheels and second via a feed assembly. The infeed wheels are typically located immediately inside of the strapping machine (e.g., inside of an enclosure or cabinet). There are a variety of dispenser mounting arrangements. In one arrangement, the dispenser is externally mounted to the machine. In another arrangement, the dispenser is a complete, stand-alone unit. In that strapping machines are used in commercial and/or manufacturing environments, it is often desirable to minimize the space, e.g., foot-print of such equipment items. And, in that it is desirable to extend the length of time between required reloading of strapping material, the dispensers (or coils of strap material) are relatively large. In these arrangements, the running or routing of strap material is, at least in part, external of the strapping machine. As such, there always exists the possibility of the strap material being damaged by some outside occurrence, or being subjected to adverse environmental conditions or the like.

Still other strapping machines are known that include a dispenser mounted within the strapping machine. That is, the coil of strap material is mounted to a stub or spindle that is positioned under the top surface of the machine. To assure that the strap material feeds out properly, the coil is mounted in such a manner that the axis about which the coil rotates is horizontal.

However, in that the strapping machines are typically configured at an ergonomic work height, the spindle about which the coil rotates is mounted at a relatively low height. That is, in order to change out a coil of material, the operator must bend down and reach into the machine to extract the old or used coil and position the new, full coil on the stub. This can be a difficult task in that the coil of material can be quite heavy.

Accordingly, there is a need for a strapping machine having an improved dispenser (coil) location and loading arrangement. More desirably, in such an arrangement the dispenser or coil is located internally of the strapping machine and is readily accessible and easily loaded or reloaded in the machine.

BRIEF SUMMARY OF THE INVENTION

A dispenser assembly for a strapping machine provides ready accessibility and ease of loading or reloading a coil of strap material in the machine. A typical strapping machine is of the type having a frame supporting a feed assembly and a chute. The strapping machine includes a strapping head disposed between the feed assembly and the chute. The strapping machine is configured to receive first and second courses of associated strap material, position, tension and seal the strap material around a load.

The strap material is provided on a coil having a axis of rotation about which the coil rotates to dispense the strap material. The dispenser assembly includes a support panel hingedly mounted to the frame. The support panel is pivotable between an open position and a closed position. The support panel is mounted to the machine frame by pivot pins.

The support panel includes a central hub defining an axis for carrying the coil of strap material. The hub is mounted to the support panel such that the axis is in a substantially horizontal orientation when the panel is closed and in a substantially upstanding orientation when the panel is open.

A latching element securing the support panel in the closed position. A handle can be operably connected to the latching element. A biasing element such as a spring can bias the latching element to a latched position.

In a present dispensing assembly, a supporting flange is mounted to the door, and the central hub extends centrally from the support flange. The central hub can include a core and a stub extending outwardly therefrom. The core is configured for receiving the coil of strap material thereon. Spacers can be mounted to the core for engaging and stabilizing the coil of strap material. An outer locking flange secures the coil of strap material to the central hub. In such an arrangement, the stub extends though an opening in a center of the outer locking flange and including a locking element, such as a threaded nut, is engageable with the stub for locking the locking flange in place.

A strapping machine having a pivoting dispenser loading assembly is also disclosed.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
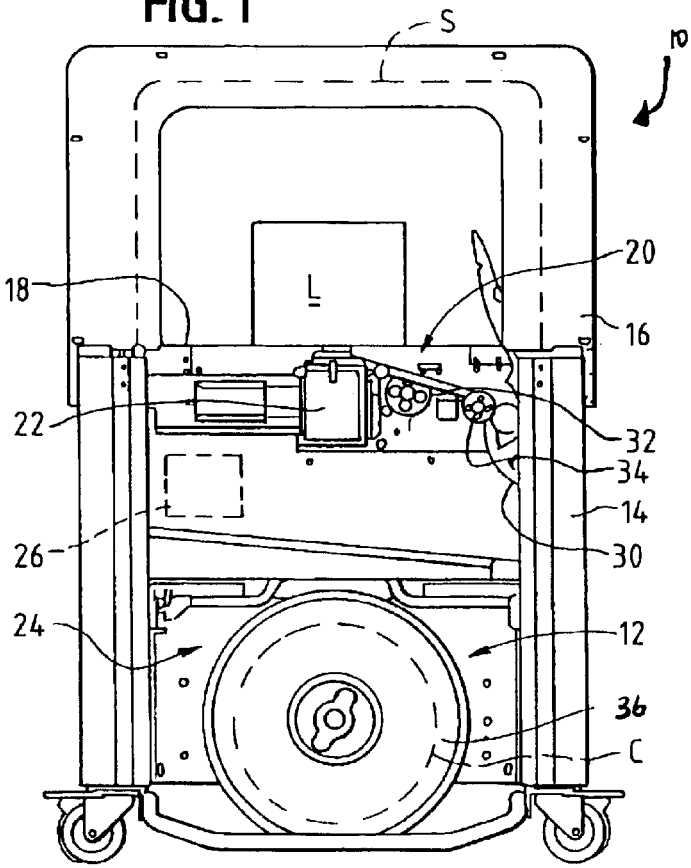
FIG. 1 is a front view of an exemplary strapping machine having a pivoting dispenser loading assembly embodying the principles of the present invention.
Figure 2:
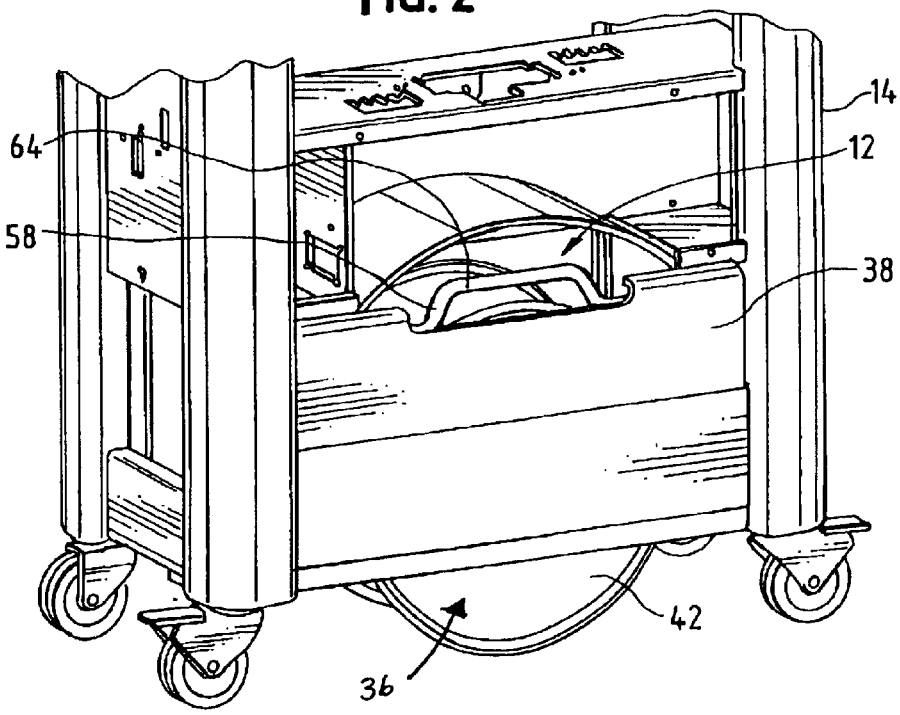
FIG. 2 is a perspective rear view of the strapping machine shown with the dispenser loading assembly in the loaded or closed position.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring to the figures and in particular FIG. 1, there is shown a strapping machine 10 having a pivoting dispenser loading assembly 12 embodying the principles of the present invention. The strapping machine 10 includes, generally, a frame 14, a strap chute 16 and a table top or work surface 18. A feed assembly 20 and a strapping head 22 are mounted below the work surface 18 in an internal area (indicated generally at 24) of the strapping machine 10. A controller 26 provides automatic operation and control of the strapper 10.

The strapping head 22 receives strapping material S from a coil C that is loaded onto a dispenser 12. The strap S is fed or pulled from the coil C by infeed wheels, located generally at 30, but not shown. The feed assembly 20, includes feed wheels 32 and tensioning wheels 34 for feeding strap material S into the strapping head 22 and chute 16 (for conveyance around the chute 16) and for taking-up or tensioning the strap material S around the load L.

Figure 3:
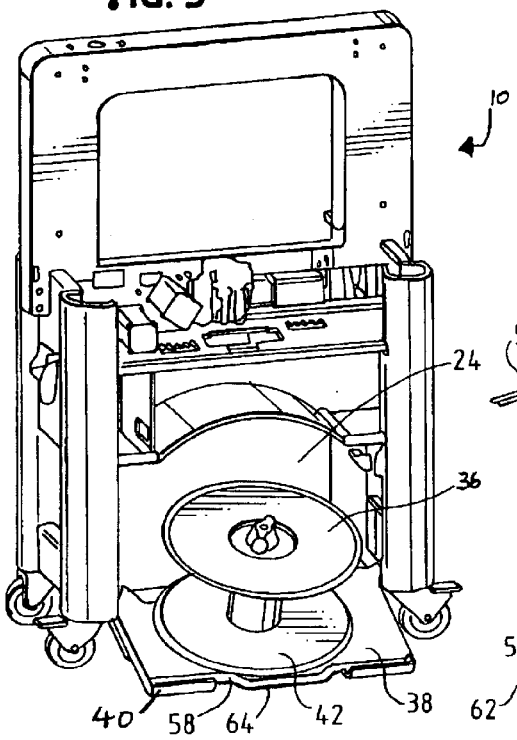
FIG. 3 is a perspective view of the strapping machine shown with the dispenser loading assembly in the open or loading position and shown with a coil of material loaded therein.
Figure 5:
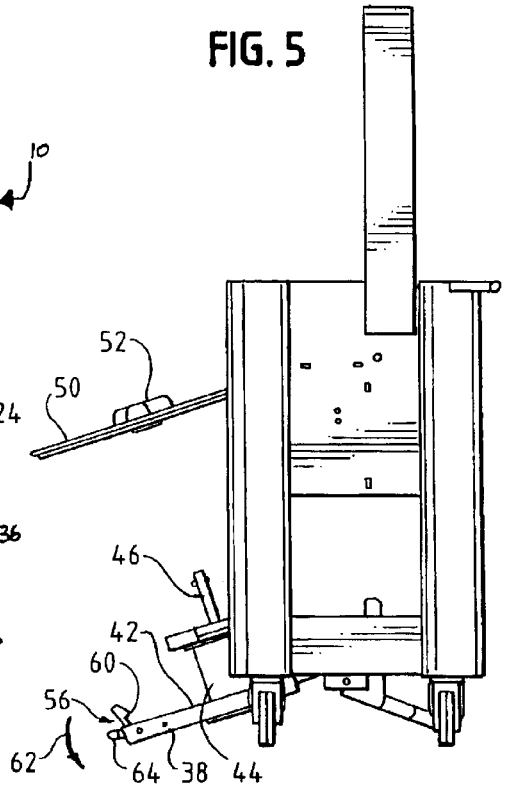
FIG. 5 is a side view of the strapping machine as seen in FIG.
Figure 4:
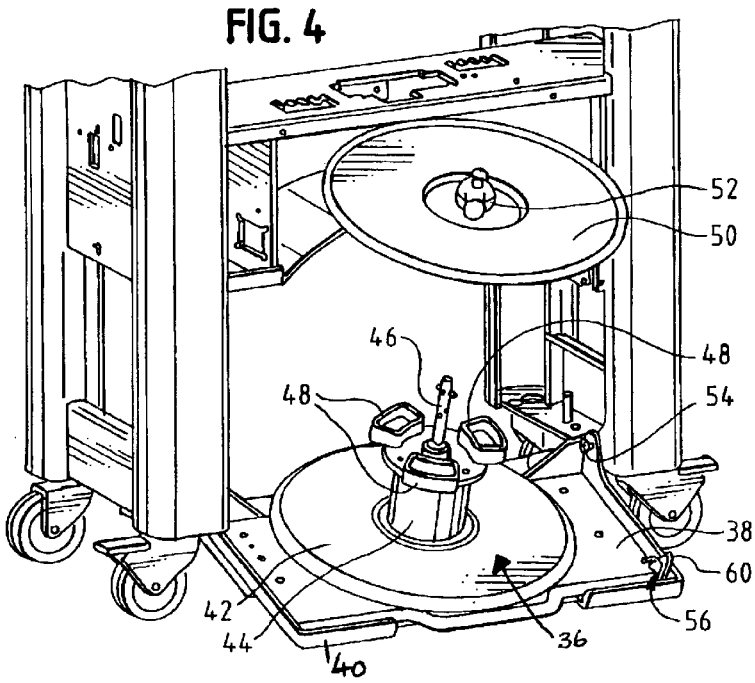
FIG. 4 is a perspective view of the strapping machine similar to FIG. 3, but shown with the shown with the side flange removed for installing a coil of strap material.

Unlike known strapping machines that have the dispenser mounted to an outside surface of the machine or that use a stand-alone dispenser, the present strapping machine 10 includes a pivoting dispenser loading assembly 12 in which the strap material coil C is mounted to the machine 10 and is positioned in the internal region 24 of the machine 10. A seen in FIGS. 3 and 4, the coil C is supported on a hub 36 that is mounted to a door or access panel 38 of the machine 10. In a present machine 10, the door 38 is hinged to the frame 14 so that it pivots downwardly, with the top edge 40 of the door 38 pivoting toward the floor on which the machine 10 is supported.

A supporting flange 42 is mounted to the door 38. The hub 36 extends from the flange 42 and includes a first portion having a core 44 onto which the coil C is fitted and a stub or projection 46 concentric with the flange 42 and the core 44. The core 44 can include centering fittings 48 to maintain the coil C centered on the core 44.

The assembly 12 includes an outer, locking flange 50 that is positioned on the stub 46, over the side of the coil C. In this manner, the coil C is completely enveloped (on its sides) by the supporting flange 42 and the locking flange 50, and any rotating parts (i.e., the coil C) are within or between the flanges 42, 50. The stub 46 can be threaded to receive a threaded nut 52 or the like to secure the flange 50 over the coil C and to the stub 46.

In a present machine, the door 38 is mounted to the frame 14 by a pair of pivot pins 54 and is retained in place (in the closed or operating position) by a latch mechanism 56. The latch 56 is operated by a handle 58 (that is also used to raise or lower the door 38), that includes a hook portion 60 that engages and locks into the top surface 18 or frame 14 to secure the door 38 in a closed position. Rotating the handle 58 outwardly (away from the machine 10, as indicated by the arrow at 62) disengages the hook 60 from the frame 14 or top 18 to permit opening the door 38. The handle 58 is formed having a raised portion 64 at about the midsection for ease of elevation over the door 38 and for ease of grasping and rotating.

Advantageously, the present assembly 12 permits the coils C to be readily lifted (and lowered) onto the hub 36 without reaching in to the machine 10. After loading a coil C onto the hub 36, by simply raising the door 38, the coil C is in place in the machine 10 for continued operation. The readily opened (rotated) door 38 can alleviate a considerable amount of stress and strain (on an operator), in loading and/or reloading a strap material coil C in the machine 10 by eliminating the need for the operator to lift the heavy coil and place the coil onto a stub within the internal machine area.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A dispenser assembly for a strapping machine of the type having a frame supporting a feed assembly and a chute, the strapping machine including a strapping head disposed between the feed assembly and the chute, the strapping machine configured to receive first and second courses of associated strap material, position, tension and seal the strap material around a load, the strap material provided on a coil having an axis of rotation about which the coil rotates to dispense the strap material, the dispenser assembly comprising:

a support panel hingedly mounted to the frame, the support panel pivotable between an open position and a closed position, the support panel including a central hub defining an axis for carrying the coil of strap material, the hub mounted to the support panel such that the axis is in a substantially horizontal orientation when the panel is closed and in a substantially upstanding orientation when the panel is open; and a latching element for securing the support panel in the closed position.

2. The dispenser assembly in accordance with claim 1 including a handle, and wherein the latching element is operably connected to the handle.

3. The dispenser assembly in accordance with claim 2 wherein the latching element includes a hook portion.

4. The dispenser assembly in accordance with claim 1 including a supporting flange mounted to the support panel, wherein the central hub extends centrally from the support flange.

5. The dispenser assembly in accordance with claim 1 wherein the central hub includes a core and a stub extending outwardly therefrom, the core configured for receiving the coil of strap material thereon.

6. The dispenser assembly in accordance with claim 5 including spacers mounted to the core for engaging and stabilizing the coil of strap material.

7. The dispenser assembly in accordance with claim 5 including an outer locking flange for securing the coil of strap material to the central hub, wherein the outer locking flange is positioned over the coil of strap material and the core with the stub extending through an opening in a center of the outer locking flange, and including a locking element engageable with the stub for locking the locking flange in place.

8. The dispenser assembly in accordance with claim 1 including an outer locking flange for securing the coil of strap material to the central hub.

9. The dispenser assembly in accordance with claim 1 wherein the panel is mounted to the frame by pivot pins.

10. A strapping machine of the type configured to receive first and second courses of associated strap material, position, tension and seal the strap material around a load, comprising:

a frame;

a feed assembly mounted to the frame;

a chute mounted to the frame;

a strapping head disposed between the feed assembly and the chute;

an infeed arrangement; and a strap supply for supplying strap material to the feed assembly through the infeed arrangement, the strap supply including a dispenser assembly, the dispenser assembly including a support panel hingedly mounted to the frame, the support panel pivotable between an open position and a closed position, the support panel including a central hub defining an axis for carrying the coil of strap material, the hub mounted to the support panel such that the axis is in a substantially horizontal orientation when the panel is closed and in a substantially upstanding orientation when the panel is open.

11. The strapping machine in accordance with claim 10 including a latching element for securing the support panel in the closed position.

12. The strapping machine in accordance with claim 11 including a handle, and wherein the latching element is operably connected to the handle.

13. The dispenser assembly in accordance with claim 11 wherein the latching element includes a hook portion.

14. The strapping machine in accordance with claim 10 including a supporting flange mounted to the support panel, wherein the central hub extends centrally from the support flange.

15. The strapping machine in accordance with claim 10 wherein the central hub includes a core and a stub extending outwardly therefrom, the core configured for receiving the coil of strap material thereon.

16. The strapping machine in accordance with claim 15 including spacers mounted to the core for engaging and stabilizing the coil of strapped material.

17. The strapping machine in accordance with claim 15 including an outer locking flange for securing the coil of strap material to the central hub, wherein the outer locking flange is positioned over the coil of strap material and the core with the stub extending through an opening in a center of the outer locking flange, and including a locking element engageable with the stub for locking the locking flange in place.

18. The strapping machine in accordance with claim 10 including an outer locking flange for securing the coil of strap material to the central hub.

* * * * *